US009339712B2

(12) United States Patent
De Biasi

(10) Patent No.: US 9,339,712 B2
(45) Date of Patent: May 17, 2016

(54) EXERCISER

(71) Applicants: Raffaele De Biasi, Bussolengo (IT); Giorgio De Biasi, Bussolengo (IT)

(72) Inventor: Raffaele De Biasi, Bussolengo (IT)

(73) Assignees: Raffaele De Biasi, Bussolengo (VR) (IT); Giorgio De Biasi, Bussolengo (VR) (IT)

( * ) Notice: Subject to any disclaimer, the term of this patent is extended or adjusted under 35 U.S.C. 154(b) by 0 days.

(21) Appl. No.: 14/253,173

(22) Filed: Apr. 15, 2014

(65) Prior Publication Data

US 2014/0329645 A1 Nov. 6, 2014

(30) Foreign Application Priority Data

Apr. 16, 2013 (IT) ..... VR2013A0089

(51) Int. Cl.
*A63B 69/18* (2006.01)
*A63B 69/00* (2006.01)

(52) U.S. Cl.
CPC ..... *A63B 69/18* (2013.01); *A63B 69/0022* (2013.01)

(58) Field of Classification Search
CPC ..... A63B 21/00003; A63B 21/00094; A63B 21/00098; A63B 21/00123; A63B 21/00127; A63B 21/012; A63B 21/0125; A63B 21/015; A63B 21/018; A63B 22/0015; A63B 22/0046; A63B 22/0061; A63B 22/0064; A63B 22/0069; A63B 22/08; A63B 22/18; A63B 22/20; A63B 22/201; A63B 22/203; A63B 2022/0017; A63B 2022/0025; A63B 2022/0028; A63B 2022/003; A63B 2022/0038; A63B 2022/0051; A63B 2022/0071; A63B 2022/0092; A63B 2022/185; A63B 2022/206; A63B 23/035; A63B 23/03508; A63B 23/03516; A63B 23/03533; A63B 23/03541; A63B 23/04; A63B 23/0405; A63B 23/0482; A63B 23/0488; A63B 23/0494; A63B 2026/006; A63B 69/0022; A63B 69/0057; A63B 69/18; A63B 69/182; A63B 2069/0062; A63B 2208/0204; A63B 2208/0209; A63B 2244/18; A63B 2244/183; A63B 2244/186; A63B 2244/19; A63B 21/1465; A63B 21/1492; A63B 21/1496; A63B 21/15
USPC ..... 482/70, 71
See application file for complete search history.

(56) References Cited

U.S. PATENT DOCUMENTS

| | | | | |
|---|---|---|---|---|
| 3,531,110 | A * | 9/1970 | Marchu | 482/71 |
| 3,708,163 | A * | 1/1973 | Hynes | 482/71 |
| 4,149,713 | A * | 4/1979 | McLeod | 482/101 |
| 4,396,189 | A * | 8/1983 | Jenkins | 482/71 |

(Continued)

FOREIGN PATENT DOCUMENTS

| | | |
|---|---|---|
| FR | 2692800 | 12/1993 |
| WO | WO0001450 | 1/2000 |

OTHER PUBLICATIONS

International Search Report dated Dec. 10, 2013 for Italian Application No. VR2013000089.

*Primary Examiner* — Oren Ginsberg
*Assistant Examiner* — Gary D Urbiel Goldner
(74) *Attorney, Agent, or Firm* — Tutunjian & Bitetto, P.C.

(57) ABSTRACT

An exercise equipment including a support, a first footboard and a second footboard for supporting the feet of the user, arranged alongside one another and able to slide along the support according to a substantially rectilinear direction (A), and articulated connection elements for connecting the first footboard to the second footboard.

10 Claims, 6 Drawing Sheets

(56) References Cited

U.S. PATENT DOCUMENTS

| | | | | | |
|---|---|---|---|---|---|
| 4,669,723 | A * | 6/1987 | Arsenian | 482/71 |
| 4,744,558 | A * | 5/1988 | Smirmaul | 482/71 |
| 4,781,372 | A * | 11/1988 | McCormack | 482/70 |
| 4,811,941 | A * | 3/1989 | Elo | 482/51 |
| 4,915,373 | A * | 4/1990 | Walker | 482/51 |
| 5,147,257 | A | 9/1992 | Loane | |
| 5,277,681 | A * | 1/1994 | Holt | 482/112 |
| 5,316,530 | A * | 5/1994 | Romer | 482/71 |
| 5,328,427 | A * | 7/1994 | Sleamaker | 482/71 |
| 5,429,567 | A * | 7/1995 | Gerschefske et al. | 482/70 |
| 5,496,239 | A | 3/1996 | Kallman et al. | |
| 5,503,609 | A * | 4/1996 | Bull | 482/70 |
| 5,718,658 | A * | 2/1998 | Miller et al. | 482/71 |
| 5,749,811 | A * | 5/1998 | Wilson | 482/71 |
| 5,895,340 | A * | 4/1999 | Keller | 482/71 |
| 5,911,650 | A * | 6/1999 | Cox | 482/70 |
| 6,234,935 | B1 * | 5/2001 | Chu | 482/51 |
| 7,115,073 | B2 * | 10/2006 | Nizamuddin | 482/51 |
| 7,425,189 | B1 * | 9/2008 | Eschenbach | 482/52 |
| 7,682,293 | B2 * | 3/2010 | Eschenbach | 482/62 |
| 7,901,332 | B1 * | 3/2011 | Wen | 482/52 |
| 8,205,895 | B2 * | 6/2012 | Chen et al. | 280/87.041 |
| 8,328,209 | B2 * | 12/2012 | Tsai | 280/87.043 |
| 8,505,945 | B2 * | 8/2013 | Chen | 280/220 |
| D727,434 | S * | 4/2015 | O'connell | D21/423 |
| 2004/0097335 | A1 * | 5/2004 | Chu | 482/51 |
| 2004/0241631 | A1 * | 12/2004 | Nizamuddin | 434/253 |
| 2005/0079956 | A1 * | 4/2005 | Bruno | 482/51 |
| 2006/0046902 | A1 * | 3/2006 | Chang | 482/52 |
| 2006/0247105 | A1 * | 11/2006 | Baydzhanov | 482/71 |
| 2007/0135280 | A1 * | 6/2007 | Hamer | 482/132 |
| 2007/0225130 | A1 * | 9/2007 | Maffei et al. | 482/71 |
| 2009/0176631 | A1 | 7/2009 | Blessing | |
| 2009/0239713 | A1 * | 9/2009 | Chu | 482/51 |
| 2010/0234186 | A1 * | 9/2010 | Fan | 482/51 |
| 2014/0031175 | A1 * | 1/2014 | Peralo | 482/66 |
| 2014/0194253 | A1 * | 7/2014 | Huang et al. | 482/52 |
| 2014/0194254 | A1 * | 7/2014 | Huang et al. | 482/52 |

* cited by examiner

EXERCISER

TECHNICAL FIELD OF THE INVENTION

The present invention concerns an exercise equipment.

More in particular, the present invention concerns an exercise equipment that is suitable for simulating the movements that are typical of skating, or other similar sports.

DESCRIPTION OF RELATED ART

In the field of exercise equipment, both for the gym and for domestic private use, special equipment are known that simulate the movements that are typical of skating.

In particular, these equipment are conceived so as to both allow any user to carry out physical activity so as to tone up the body and burn calories, and to allow skaters—whether amateur or professional—to train specific muscle groups that are involved in such a sport activity.

Known equipment for simulating skating movements are in truth machines that are quite complex, very bulky and costly.

Indeed these are machines the operation of which is normally managed by a computer through which it is possible to set the various training parameters, for example duration, intensity, and more, and that provides the user by means of a monitor interface with information on his performance, for example the calories burnt, and more.

Due to both the high purchasing cost and management and maintenance costs, these equipment are mainly intended to be installed in gyms or the like.

This of course penalises the single user who intends to train privately without having to pay excessive costs.

Moreover, also in terms of the movements carried out, known equipment have aspects which are often unsatisfactory for the user who intends to carry out a specific training for practicing skating.

For example, mainly for reasons concerning its bulk, these equipment allow only very limited lateral excursion movements to be carried out, which therefore does not fully simulate the real and natural movements that are carried out in skating.

This is due to the fact that these machines are normally positioned beside one another in rows of many units in gyms, and they must therefore have a side bulk that is necessarily small even to allow the manager of the gym to install as many machines as possible.

Again for reasons concerning containing the bulk, known types of machines, in addition to having limited lateral excursion, are also characterised in that they have movements that follow trajectories in space that are substantially inclined with respect to the horizontal plane: this fact also generates movements of the user which are quite different from those he carries out when skating.

SUMMARY OF THE INVENTION

The technical task of the present invention is thus that of improving the state of the art.

In the field of such a technical task, one purpose of the present invention is to devise an exercise equipment, that is suitable for simulating movements that are typical of skating, which is constructively simpler and cost-effective with respect to known exercise equipment.

Another purpose of the present invention is to make an exercise equipment that is suitable for simulating the movements that are typical of skating that makes it possible to carry out movements that are much more similar to those that are carried out in the real activity, for example in terms of the lateral excursion and of the trajectories that are carried out by the lower limbs, with respect to what is possible to carry out with known exercise equipment.

This task and these purposes are achieved by the exercise equipment according to the present principles.

The exercise equipment according to the invention comprises a support, a first footboard and a second footboard, for supporting the feet of the user, arranged alongside one another and able to slide along the support according to a direction that is substantially rectilinear, and articulated connection means for connecting the first footboard to the second footboard.

The description refers to preferred and advantageous embodiments of the invention.

BRIEF DESCRIPTION OF THE DRAWINGS

The characteristics of the invention shall become clearer to any man skilled in the art from the following description and from the attached drawing tables, given as a non-limiting example, in which.

DETAILED DESCRIPTION OF THE INVENTION

Figure 1:
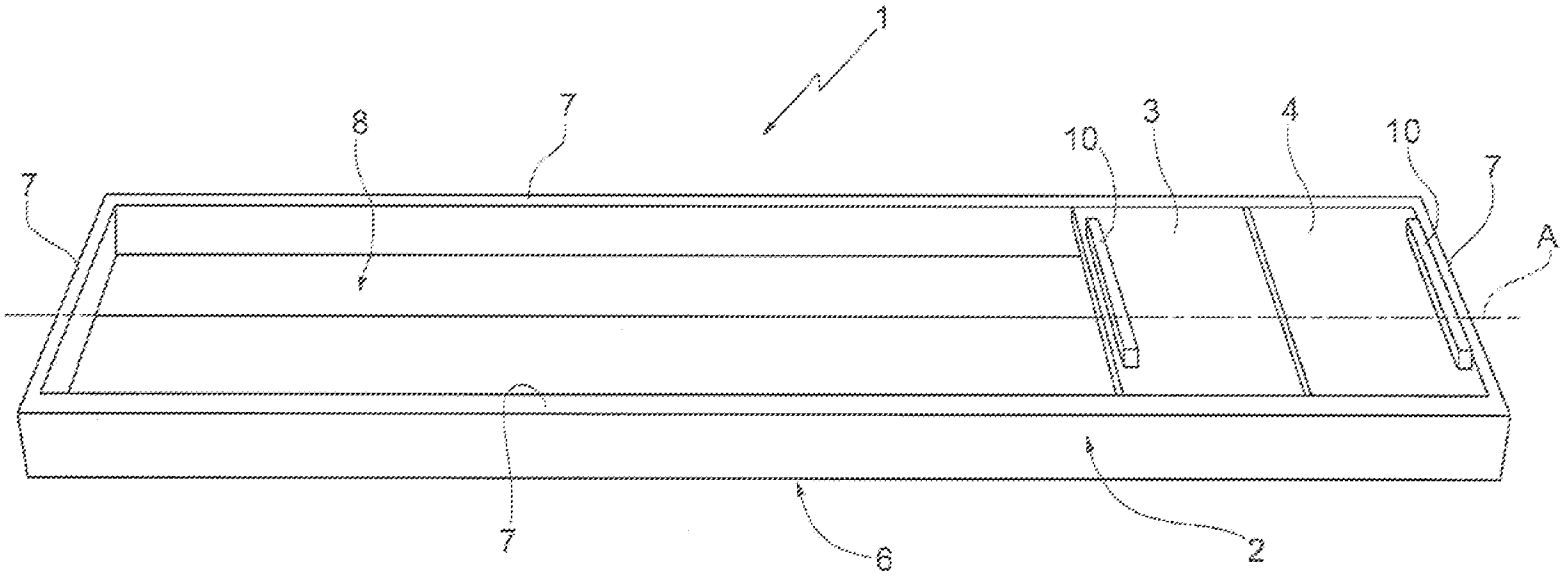
FIG. 1 is a perspective view of the exercise equipment according to the invention.

With reference to the attached FIG. 1, reference numeral 1 wholly indicates an exercise equipment according to the present invention.

In particular, the exercise equipment 1 according to the present invention is suitable for allowing the user to carry out repeated movements that simulate those which are typical of skating, or other similar sport activities.

The equipment 1 comprises a support 2.

The equipment 1 further comprises a first footboard 3 and a second footboard 4.

The first footboard 3 and the second footboard 4 act as a support for the feet of the user, as shall become clearer in the rest of the description.

The first footboard 3 and the second footboard 4 are arranged alongside one another in the support 2.

The first footboard 3 and the second footboard 4 can slide along the support 2 according to a direction that is substantially rectilinear A.

The exercise equipment 1 moreover comprises articulated connection means, which are wholly indicated with reference numeral 5, for connecting the first footboard 3 to the second footboard 4, the operation of which shall become clearer in the rest of the description.

The support 2 has a substantially flat rectangular shape.

The aforementioned substantially rectilinear direction A is thus parallel to the long sides of the support 2.

In practice, the support 2 has a shape that is substantially the shape of a box that is open at the top, inside which the first footboard 3 and the second footboard 4 can move.

The support 2 moreover comprises a lower closing plane 6.

The support 2 could have any other shape that is suitable for the application.

The support 2 comprises perimetrical side panels 7 which wrap around the first footboard 3 and the second footboard 4 as shown in FIG. 1, preventing it from accidentally coming out.

The support 2 can be made in any suitable material for the application.

The support 2 can be made for example in metal, or in plastic material, or in any other material having the necessary mechanical characteristics.

The support 2 comprises a sliding plane 8 above which the first footboard 3 and the second footboard 4 are mobile.

Along the sliding plane 8 it can be foreseen for there to be at least one groove 9 that defines the aforementioned substantially rectilinear direction of movement A of the first footboard 3 and of the second footboard 4.

Such an at least one groove 9 acts as a sliding guide for the first footboard 3 and the second footboard 4.

Figure 6:
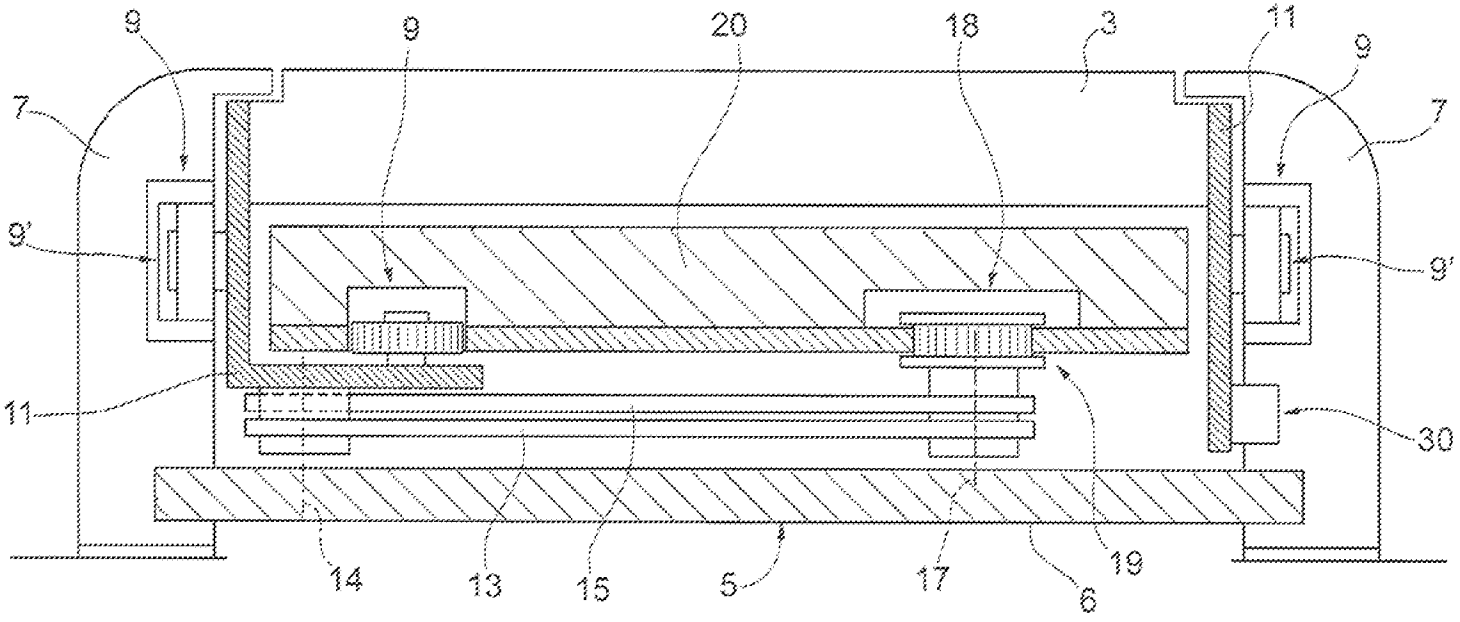
FIG. 6 is a section view of the exercise equipment according to FIG. 1, in a further version.

In one version represented in FIG. 6, the at least one groove 9 is positioned laterally along the sliding plane 8, in particular in the peripheral side panels 7 that are positioned at the long sides of the support 2.

In a further version of the invention, the groove 9 can be positioned below the supporting plane 8, so that it is protected from dust, dirt, etcetera, and so that it is protected from the support plane 8 itself.

According to a further version of the invention, the sliding guides or grooves can be made in a material such as to make them interchangeable, or silent and in any case durable.

The first footboard 3 and the second footboard 4 are constructively identical.

More in detail, the first footboard 3 and the second footboard 4 each have a substantially rectangular shape and dimensions that are suitable for supporting the feet of any user in a comfortable manner.

The first footboard 3 and the second footboard 4 each comprise a respective side relief 10 which promotes the stable support of the foot and prevents accidental movements from occurring.

The first footboard 3 and the second footboard 4 can be covered, at the top, with anti-slip material.

The first footboard 3 and the second footboard 4 can be made in the same material as the support 2, or even in a different material, preferably a strong one. The weight of each footboard 3, 4 can give greater or smaller resistance to the exercise carried out on the exercise equipment 1 according to the present invention.

The first footboard 3 and the second footboard 4 can comprise respective engagement elements along the groove 9, which are indicated with 9' in FIG. 6.

For better operating efficiency, such engagement elements 9' are substantially positioned at wheels or bearings 12, as described in greater detail in the rest of the description.

Such engagement elements can be for example made up rolling bearings.

Figure 4:
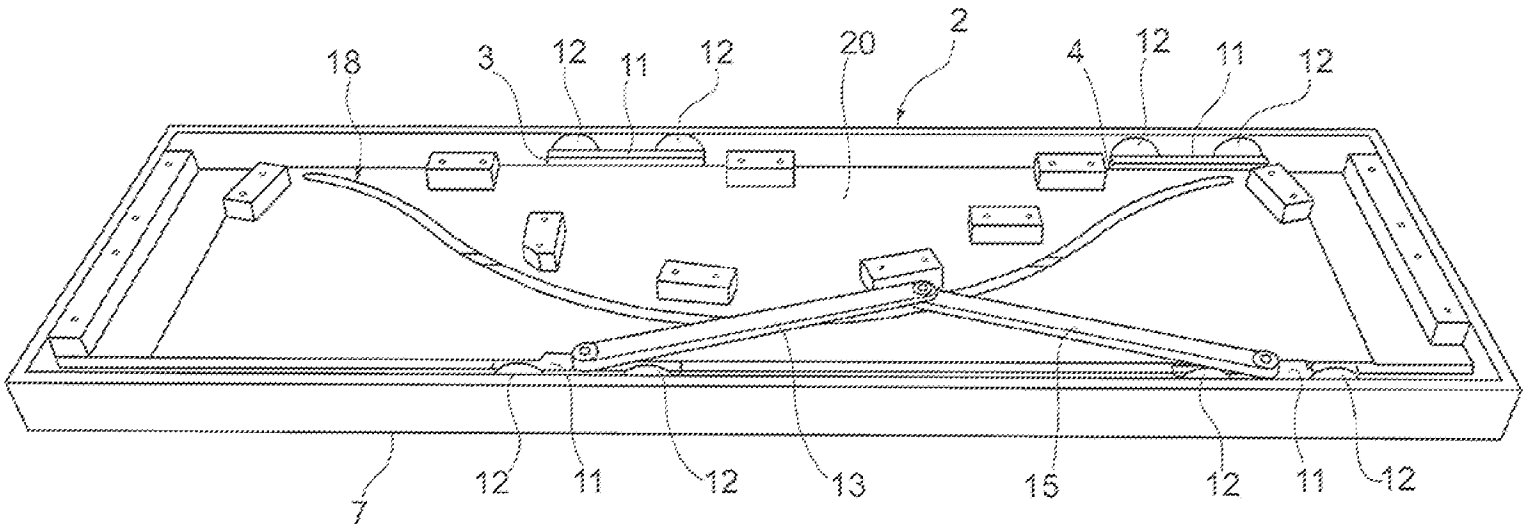
FIG. 4 is a perspective view from below of the exercise equipment in an operating step according to FIGS. 2 and 3.
Figure 5:
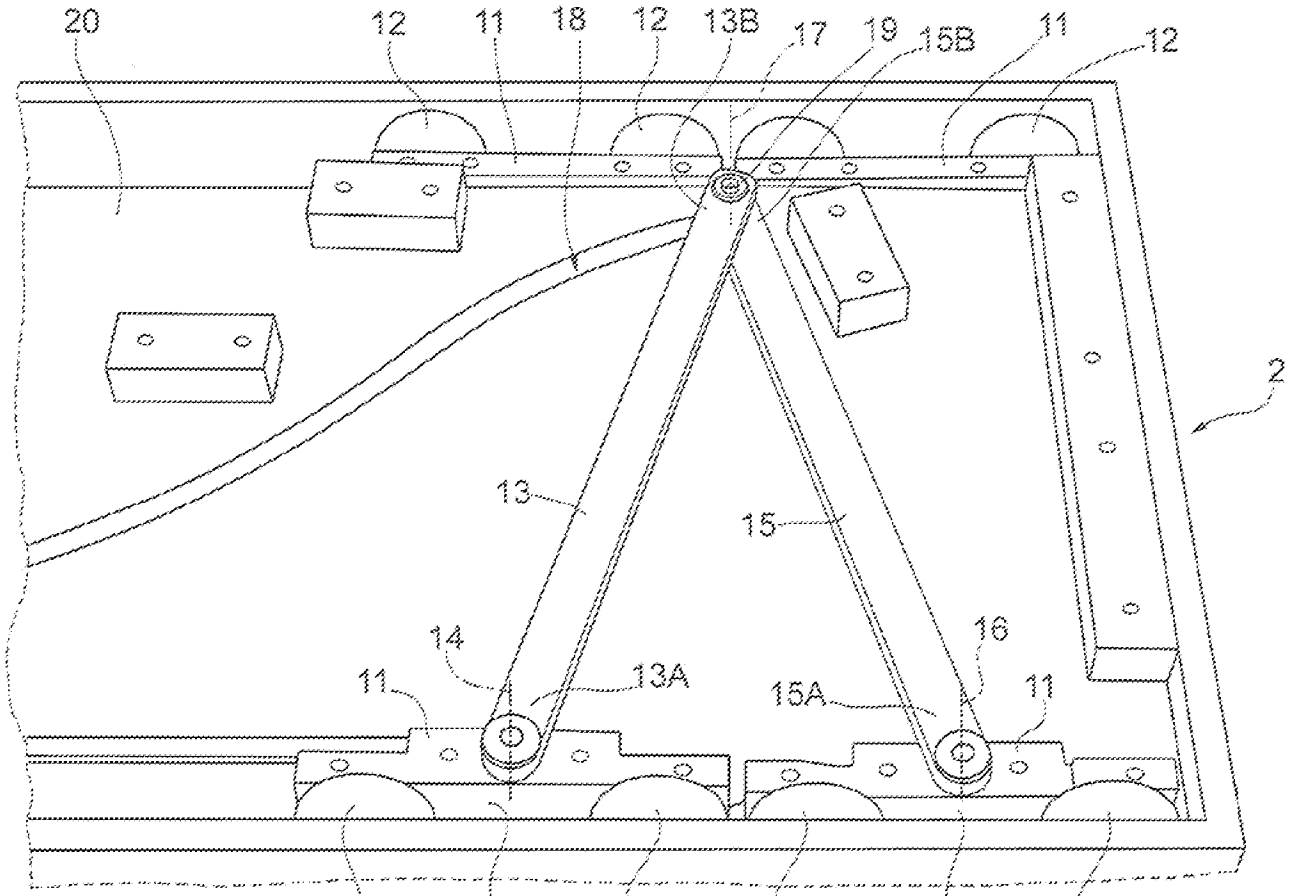
FIG. 5 is a perspective view from below and a detail of the exercise equipment according to FIGS. 2, 3, 4 in another operating step.

The first footboard 3 and the second footboard 4 each comprise two respective end appendages 11 that are folded back downwards, which are visible for example in FIGS. 4, 5 and 6.

Figure 7:
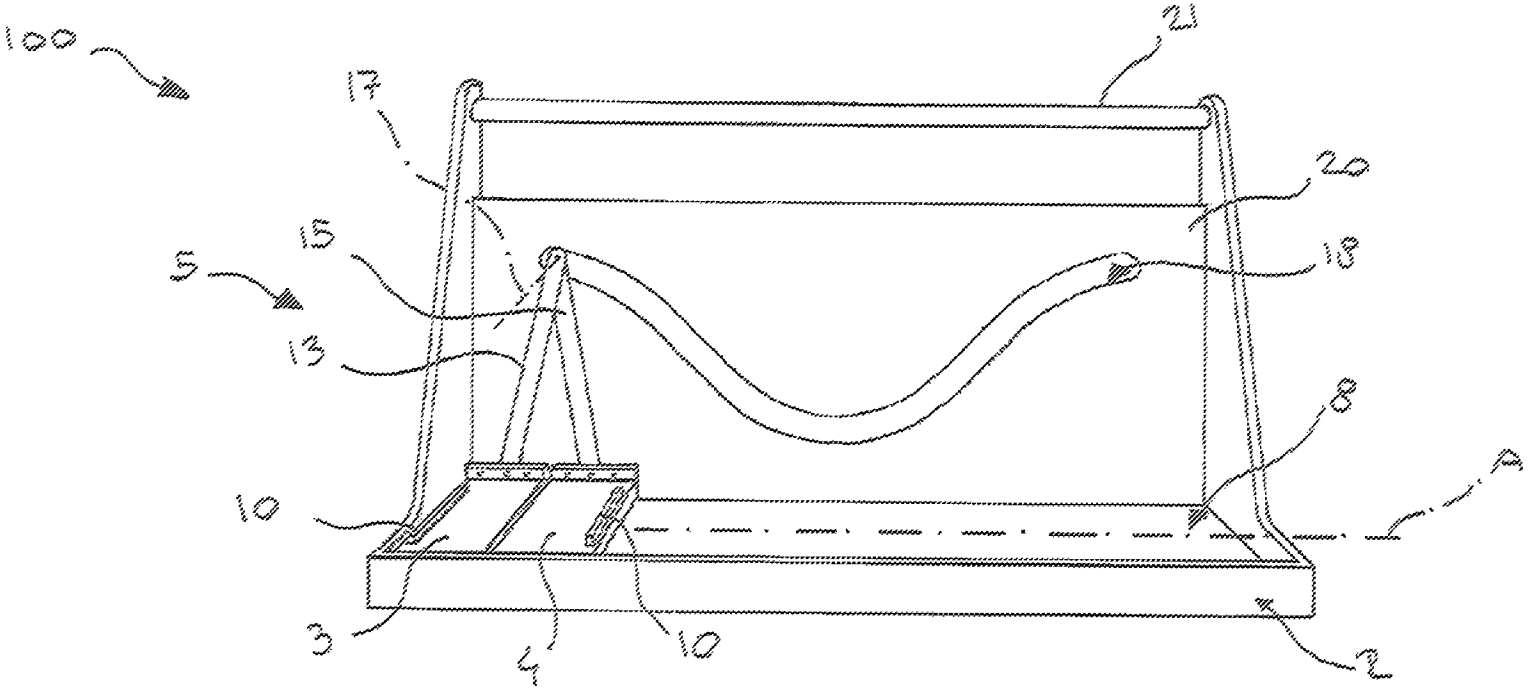
FIG. 7 is a perspective view from above of a further version of the exercise equipment according to the present invention.

In a further version of the invention, for example illustrated in FIG. 7, at least some of such end appendages 11 of the first footboard 3 and of the second footboard 4 can be folded upwards.

The first footboard 3 and the second footboard 4 further comprise at least one pair of wheels or bearings 12. In one version of the invention, the first footboard 3 and the second footboard 4 comprise two respective pairs of wheels or bearings 12.

The wheels or bearings 12 can be made in polyurethane material, so as to ensure that the exercise equipment according to the present invention is silent.

The wheels or bearings 12 are suitable for rolling on the lower plane 6 of the support 2 or in suitable grooves 9 that are positioned along the side panels 7 of the support 2. In a further version of the invention, such wheels or bearings 12 are suitable for rolling or sliding in suitable guides, positioned in a suitable space of the support 2.

For each footboard 3, 4, in one version of the invention, the at least one pair of wheels or bearings 12 are rotatably supported respectively inside the two end appendages 11.

In one version of the invention, the articulated connection means 5, which are visible in FIGS. 4, 5, 6, are positioned below the sliding plane 8.

More in detail, the articulated connection means 5 comprise a first rod 13.

The first rod 13 comprises a first end 13A and a second end 13B.

The second end 13B is opposite the first end 13A.

The first rod 13 is articulated with the first footboard 3 at its first end 13A, in a first rotation axis 14.

The first rotation axis 14 is foreseen at one of the end appendages 11 of the first footboard 3.

The articulated connection means 5 moreover comprises a second rod 15.

The second rod 15 comprises a first end portion 15A and a second end portion 15B.

The second end portion 15B is opposite to the first end portion 15A.

The second rod 15 is articulated with the second footboard 4 at its first end portion 15A, in a second rotation axis 16.

The second rotation axis 16 is foreseen at one of the end appendages 11 of the second footboard 4.

The second end 13B of the first rod 13 and the second end portion 15B of the second rod 15 are articulated with one another at a third rotation axis 17.

The articulated connection means 5 also comprise a guide 18.

The guide 18, in one version of the invention, is foreseen in the support 2 of the exercise equipment 1.

An articulation pin 19, for articulating the second end 13B of the first rod 13 and of the second end portion 15B of the second rod 15 at the aforementioned third rotation axis 17, is mobile along the guide 18.

In particular, at the pin 19 it is foreseen for there to be a bearing that rolls along the guide 18; alternatively, it can be foreseen for there to be other equivalent means that make it possible for there to be sliding without friction of the pin 19 along the guide 18.

The support 2 of the equipment 1 comprises an intermediate or further panel 20 in which the guide 18 is made.

More in detail, the guide 18 is in the shape of a groove made in the intermediate or further panel 20. The guide is curvilinear, and develops along the direction that is substantially the rectilinear sliding line A of the footboards 3, 4.

Figure 2:
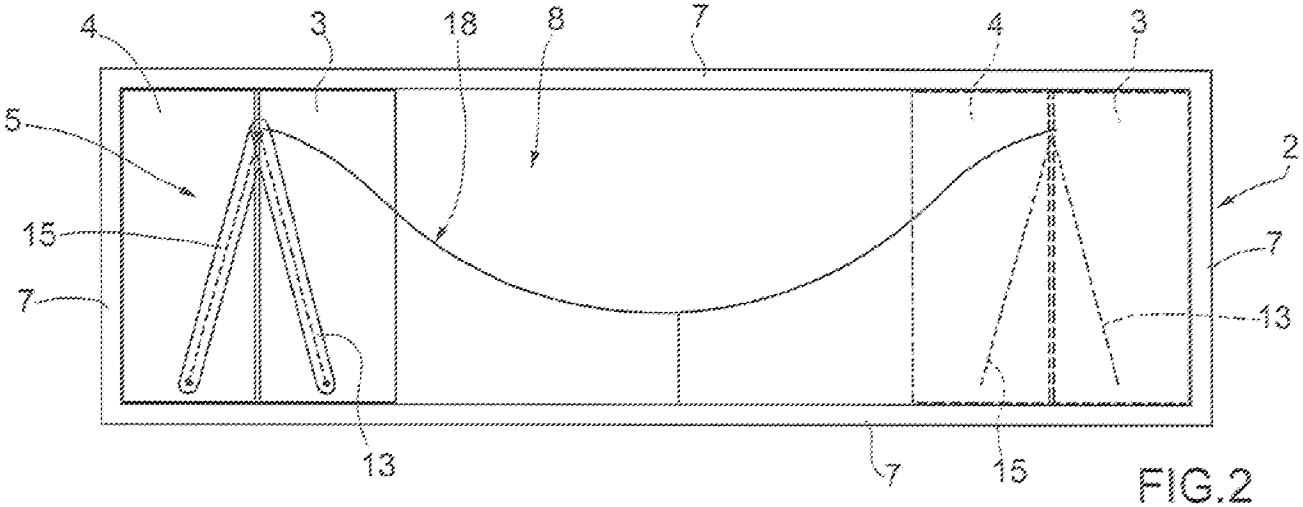
FIG. 2 is a plan view of a version of the exercise equipment in an operating step.
Figure 3:
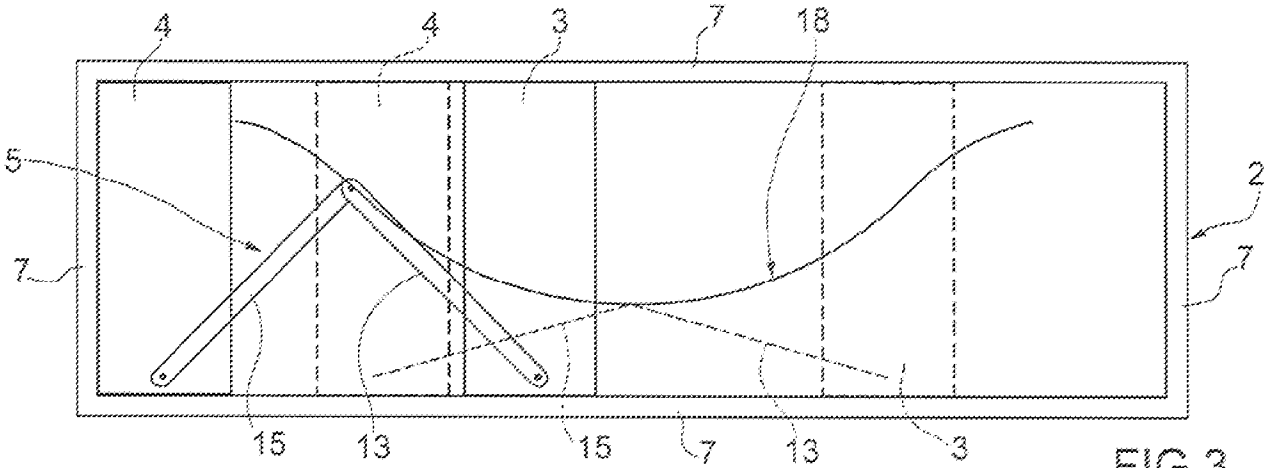
FIG. 3 is a plan view of the version according to FIG. 2 of the exercise equipment in another operating step.

According to one aspect of the present invention, the guide 18 has a substantially cosinusoidal shape, as shown in FIGS. 2, 3.

This particular shape of the guide 18 makes it possible to obtain the important technical advantages that shall be described in greater detail in the rest of the description.

According to a further aspect of the present invention, the guide 18 can also have other shapes, possibly also comprising some flat portions, so as to give particular characteristics to the movement of the first footboard 3 and of the second footboard 4.

In an embodiment thereof according to the present invention, the exercise equipment 1 can comprise means for generating a resistant, fixed or adjustable force, which is opposed to the movement of the first footboard 3 and of the second footboard 4.

In the case in which such means are of the adjustable type, the user can vary the intensity of the effort needed to carry out the movements as desired.

Such means for generating a resistant force can be of any type that is suitable for the application.

One example of such means is represented in figure in which, reference numeral 30, illustrates the adjustable friction means that are associated with the side panels 7.

In yet another embodiment of the exercise equipment 1 according to the invention, the first footboard 3 and the second footboard 4 can respectively comprise a first upper rotatable plane and a second upper rotatable plane for supporting the feet of the user.

The fact that these rotatable planes are provided allows the user to slightly rotate his foot while carrying out the movements, so as to obtain a more natural skating simulation.

The operation of the exercise equipment according to the present invention is, in the light of what has been described, completely intuitive.

FIG. 2 illustrates the starting position for carrying out the exercise.

The two footboards 3, 4 are alongside one another at one end of the support 2.

In this situation, the angle comprised between the first rod 13 and the second rod 15 is the minimum.

The user, after having rested the feet on the footboards 3, 4, carries out the lateral movement of a foot, typical of skating, inducing the first innermost footboard 3 to slide along the support 2.

In a first stage of the movement, the second footboard 4 remains stationary, until the first footboard 3 has covered at least a certain portion.

This situation is visible in FIG. 3.

During the movement of the first footboard 3, the pin 19 moves along the guide 18 until, as the angle comprised between the first rod 13 and the second rod 15 grows, the second footboard 4 is also pulled along. This particular synchronisation between the movement of the two footboards 3,4 is ensured by the substantially cosinusoidal shape of the guide 18.

The two footboards 3, 4 therefore move together until they reach the position of maximum opening, i.e. of maximum distance between the footboards 3, 4 which is illustrated with a broken line in FIG. 3.

In particular, the position of maximum opening is obtained when the pin 19 transits by the centre of the guide, corresponding to the point of minimum height of the cosinusoid.

In this phase, the angle comprised between the rods 13, 15 is the maximum.

Once such a position has been passed, the two footboards 3, 4 continue their stroke progressively coming closer until the end position is reached, in which they are alongside one another at the other end of the support 2.

In this last phase of the stroke, therefore, the angle comprised between the rods 13, 15 is progressively reduced until it reaches the minimum value.

This situation is illustrated with a broken line in FIG. 2.

The cycle is then repeated in the same way in the other direction, so as to obtain an alternating movement that simulates the movement with lateral thrust just like when skating.

In one further version of the invention, by modifying the shape of the guide 18, it is possible for the second footboard 4 to begin moving slightly together with the first footboard 3. In such a way, at the end of stroke, the arrival of the first footboard 3 on the opposite side, with respect to the initial one, the support 2 is slightly slowed down. In such a way, the first footboard 3 and the second footboard 4 never bump against the support 2. The final abutment of the first footboard 3 and of the second footboard 4 against the support 2 is then used as a strong resting point, so that the user can make the movement thereof start up along the direction A according to two alternated directions thereof.

By acting on the means for generating a resistant force—if present—or by varying the frequency of the exercise, the user can then adjust the intensity of the training as desired, obtaining greater or smaller resistance of the sliding of the footboards 3, 4 along the support.

FIG. 7 illustrates a further embodiment of the exercise equipment according to the present invention, wholly indicated by reference numeral 100.

In the rest of the description, the components corresponding to those described for the previous embodiment are indicated with the same reference numeral.

The exercise equipment 100 differs from the previous embodiment for the positioning of the intermediate or further panel 20 to which the articulated connection means 5 are operatively connected.

The intermediate or further panel 20 is positioned in a substantially perpendicular manner with respect to the sliding plane 8, at a peripheral edge of the support 2, for example along its long side.

More in detail the panel 20 is positioned near to an end of the first footboard 3 and of the second footboard 4 so that in use, it is in front of or behind a user resting on the first footboard 3 and on the second footboard 4.

Similarly to the previous embodiment, the panel 20 comprises a guide 18 along which a pin 19 is slidingly engaged through, for example, a bearing or equivalent means.

According to one version of the present invention, not illustrated in the figures, the exercise equipment can comprise a covering panel that is positioned, possibly in a removable manner, on the panel 20.

The covering panel acts as a protection for the articulated connection means 5 and/or for the guide 18, protecting them from dust, dirt, etcetera, and preventing them from accidentally being bumped by the user when the exercise equipment 100 is being used.

The articulated connection means 5 correspond to those described in the previous embodiment and, therefore, they determine an articulated connection of the first footboard 3 with the second footboard 4, synchronising them with one another.

In particular, the shape of the articulated connection means 5 of the exercise equipment 1, 100 is such as to allow an independent movement, of the first footboard 3 with respect to the second footboard 4, and vice versa, along at least one portion of the sliding plane 8.

In use, therefore, the distance between the first footboard 3 and the second footboard 4 can vary thus making it possible to obtain a more natural skating simulation.

It has thus been seen how the invention achieves the aforementioned proposed purposes.

The exercise equipment 1 according to the invention is constructively very simple, light and cost-effective.

Therefore it makes it possible to carry out the gymnastics activity of skating simulation with substantially lower costs with respect to known types of equipment that are widely available on the market. The exercise equipment also has a very small bulk, and can be easily put away when it is not being used.

Also the maintenance of the equipment is substantially simple and cost-effective, and can be also carried out by people who are not specialised technicians.

Moreover, the exercise equipment 1 according to the invention makes it possible to carry out very wide movements in terms of lateral excursion, which can be obtained with an equipment that in any case has very small dimensions.

The planar nature of the support 2 of the equipment 1 makes it possible to obtain a very realistic simulation of the skating movements.

One important advantage is given by the shape of the guide 18 for the pin 19 which makes it possible to obtain the desired synchronisation between the movement of the two footboards 3, 4.

Of course, as indicated, such a synchronised relationship between the movement of the two footboards 3,4 can be simply modified by varying the profile of the guide 18.

For example, it can be foreseen for there to be the possibility of making the intermediate or further panel 20 interchangeable so as to vary the guiding profile as desired 18, and therefore the synchronisation of the footboards 3,4.

Of course, the exercise equipment according to the invention can be provided with a control unit that manages the operation through suitable sensors, and possibly equipped with a user interface for planning the training.

Furthermore, the exercise equipment according to the invention can have a support for the user, in the form of a horizontal support bar 21 or any other equipment that is suitable for supporting the user (see also FIG. 7), for example arranged at the height of his hands, on which the user can lean or can hold on to.

Moreover, given that during the exercise a lot of force is generated, the exercise equipment can be fixed to the floor so as to prevent it from moving during the exercise. Alternatively, there can be anti-slip strips or mats to be fixed onto the portions of the exercise equipment itself for being supported on the ground.

The present invention has been described according to preferred embodiments but equivalent variants can be conceived without for this reason departing form the scope of protection offered by the following claims.

The invention claimed is:

1. Exercise equipment, comprising a support, a first footboard and a second footboard, for the support of a user's feet, that are arranged alongside and sliding along said support according to a substantially rectilinear direction (A), articulated connection means of said first footboard to said second footboard, wherein said articulated connection means comprises a first rod articulated to said first footboard, at a first end of said first rod in a first rotation axis, and a second rod articulated to said second footboard, at a first end portion of said second rod in a second rotation axis, said first rod having a second end opposite to said first end and said second rod having a second end portion opposite to said first end portion, said second end and said second end portion being articulated together in an articulation pin at a third rotation axis, wherein said articulated connection means further comprise a guide in the shape of a groove, provided along said support or along an intermediate or further plane, wherein said articulation pin of said second end and of said second end portion is mobile along said guide.

2. The exercise equipment according to claim 1, wherein said guide is curvilinear shaped and extends along said substantially rectilinear direction (A).

3. The exercise equipment according to claim 1, wherein said guide is substantially cosinusoidal in shape.

4. The exercise equipment according to claim 1, wherein said support comprises a sliding plane above which said first footboard and said second footboard are mobile, said articulated connection means being positioned beneath said sliding plane.

5. The exercise equipment according to claim 1, wherein each of said first footboard and second footboard respectively comprises at least one pair of wheels or bearings suitable for the rolling on a lower plane of said support and/or on a side wall of said support along said direction (A).

6. The exercise equipment according to claim 3, wherein at least one pair of wheels or bearings is supported in a rotatable manner in at least one of a plurality of end appendages of said first footboard and of said second footboard respectively.

7. The exercise equipment according to claim 4, wherein said first rotation axis and said second rotation axis are foreseen at one of a plurality of end appendages, respectively, of said first footboard and of said second footboard.

8. The exercise equipment according to claim 1, comprising means for generating a resistant force, fixed or adjustable, which opposes the motion of said first footboard and second footboard.

9. The exercise equipment according to claim 1, wherein said support has a substantially flat rectangular shape, said substantially rectilinear direction (A) being parallel to long sides of the substantially flat rectangular shape and/or wherein said exercise equipment further comprises a horizontal support bar or any other apparatus suitable for the user to rest against, on which the user can lean or hold on to.

10. The exercise equipment according to claim 1, wherein said support has a substantially box-shaped configuration open on a top of said support and comprising perimetrical side panels that wrap around said first footboard and said second footboard.

* * * * *